US005140785A

United States Patent [19]

Eleouet

[11] Patent Number: 5,140,785

[45] Date of Patent: Aug. 25, 1992

[54] MULTIFUNCTIONAL COMPOSITE BLOCK FOR MANUAL TREATMENT OF SURFACES

[75] Inventor: Bernard Eleouet, Saint-Leu la Foret, France

[73] Assignee: Minnesota Mining and Manufacturing Company, St. Paul, Minn.

[21] Appl. No.: 715,005

[22] Filed: Jun. 13, 1991

Related U.S. Application Data

[63] Continuation of Ser. No. 400,094, Aug. 29, 1989, abandoned.

[30] Foreign Application Priority Data

Aug. 31, 1988 [FR] France ..... 88 11393

[51] Int. Cl.[5] ..... B24D 15/04

[52] U.S. Cl. ..... 51/391; 51/401; 51/358; 51/181 R; 15/118; 15/210.1

[58] Field of Search ..... 51/394, 391, 358, 359, 51/401, 181 R; 15/209 B, 118

[56] References Cited

U.S. PATENT DOCUMENTS

| | | | |
|---|---|---|---|
| 449,930 | 4/1891 | Dubey | 51/297 |
| 866,332 | 9/1907 | Case | 76/81.3 |
| 1,257,078 | 2/1918 | Gibford | 51/181 |
| 1,301,801 | 4/1919 | Adams | 76/81 |
| 1,316,965 | 9/1919 | Marsh | 76/81 |
| 2,529,163 | 11/1950 | Knight | 15/258 |
| 2,889,667 | 6/1959 | Campbell | 51/391 |
| 2,924,049 | 2/1960 | Spain | 15/118 |
| 3,629,896 | 12/1971 | Sirnec | 15/118 |
| 4,244,074 | 1/1981 | Barcikowski et al. | 15/118 |

FOREIGN PATENT DOCUMENTS

| | | |
|---|---|---|
| 535783 | 10/1931 | Fed. Rep. of Germany . |
| 1959522 | 6/1971 | Fed. Rep. of Germany . |
| 784001 | 7/1935 | France . |

*Primary Examiner*—Robert A. Rose

*Attorney, Agent, or Firm*—Gary L. Griswold; Walter N. Kirn; William L. Huebsch

[57] ABSTRACT

A block including several different pads (1) attached to a flexible connecting sheet (2) that permits superimposing the pads in at least to two different configurations so that the surfaces of different pads define the outer surface of the block.

10 Claims, 2 Drawing Sheets

MULTIFUNCTIONAL COMPOSITE BLOCK FOR MANUAL TREATMENT OF SURFACES

This is a continuation of application Ser. No. 07/400,094 filed Aug. 29, 1989, now abandoned.

TECHNICAL FIELD

The present invention relates to cleaning, scouring, and polishing pads and materials used manually to treat surfaces such as for household or automotive maintenance or in industry.

BACKGROUND ART

Materials used manually to treat surfaces such as for household or automotive maintenance or in industry typically include numerous pads or layers of abrasive, sponge, scouring or wiping materials, some of which may become lost, and which take a lot of storage space which may be a problem in some areas such as on a kitchen sink.

DISCLOSURE OF INVENTION

The present invention combines such pads or layers of abrasive, sponge, scouring or wiping materials into a single structure or block that keeps the materials together and minimizes storage space for the materials.

According to the present invention there is provided a multifunctional composite block for manual treatment of surfaces, which block comprises at least first and second pads which may be of the same or different materials and a flexible connecting sheet. The pads are attached along the connecting sheet in spaced relationship to define a hinge portion of the connecting sheet between adjacent portions of the pads having a length permitting superimposing the pads in at least two different superimposed configurations to expose at will different surfaces of the pads or surface portions of the connecting sheet to define the outer surface of the block.

The pads can be of different materials such as abrasive material, sponge material, and scouring material without abrasive; and the flexible connecting sheet can be of a wiping material or a scouring material so that the different configurations of the block afford using the different materials on the surface to be treated.

In one preferred embodiment the block includes three pads, a major surface of the first pad is attached to a first major surface of the connecting sheet, and major surfaces of the second and third pads are attached in opposed relationship respectively to the major surfaces of the connecting sheet with the hinge portion of the connecting sheet being between the first pad and the opposed second and third pads. The length of the hinge portion between the first pad and the opposed second and third pads is greater than the sum of the thicknesses of the first and second pads and is also greater than the thickness of the third pad so that the pads can alternately be positioned in a first configuration with a surface of the third pad against a portion of the surface of the connecting sheet opposite the first pad and with surfaces of the first and second pads defining the opposite outer surfaces of the block, or in a second configuration with surfaces of the first and second pads in contact and with a surface of the third pad and the portion of the surface of the connecting sheet opposite the first pad defining the opposite outer surfaces of the block. If in this embodiment the first and second pads are of abrasive and/or scouring materials, the third pad is of sponge material, and the connecting sheet is of soft supple wiping material, surfaces of the abrasive and/or scouring materials define opposite outer surfaces of the block in the first configuration to facilitate initial cleaning, and surfaces of the sponge and wiping materials define opposite outer surfaces of the block in the second configuration to facilitate finishing of a cleaning operation.

BRIEF DESCRIPTION OF DRAWING

The present invention including additional embodiments thereof will be further described with reference to the accompanying drawing wherein like reference numerals refer to like parts in the several views, and wherein.

DETAILED DESCRIPTION

Figure 1:
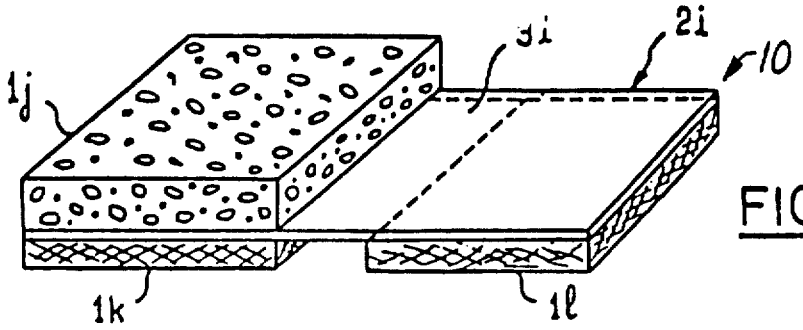
FIG. 1 is a perspective view of a first embodiment of a block according to the present invention in an unfolded configuration.
Figure 2:
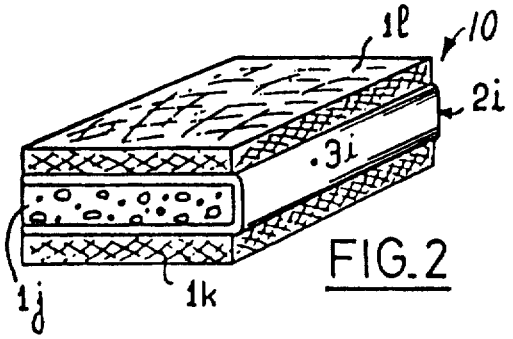
FIGS. 2 and 3 are perspective views of the block of FIG. 1 in two configurations different than the configuration of FIG. 1.
Figure 3:
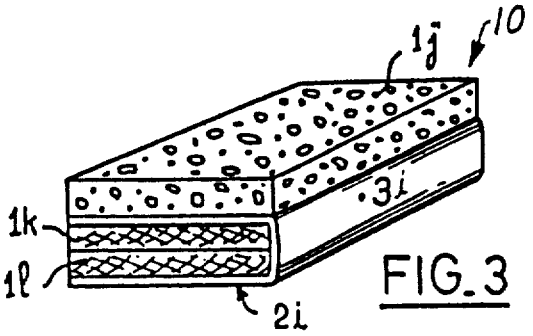

Referring now to the FIGS. 1, 2 and 3 of the drawing, there is shown a first embodiment of a multifunctional composite block 10 according to the present invention for use in the manual treatment of surfaces.

Generally the block 10 comprises first, second and third rectangular pads 1*l*, 1*k*, and 1*j* of different materials (i.e., scouring material without abrasive, abrasive material, and sponge material respectively) and a flexible connecting sheet 2*i* of a soft absorbent supple wiping material such as a natural or synthetic chamois leather. The pads 1*l*, 1*k*, and 1*j* are attached along the connecting sheet 2 in spaced relationship to define a hinge portion 3*i* of the connecting sheet 2*i* between adjacent portions of the pads 1*l*, 1*k*, and 1*j*, which hinge portion 3*i* has a length permitting superimposing the pads 1*l*, 1*k*, and 1*j* in two different superimposed configurations (FIGS. 2 and 3) to expose at will different surfaces of the pads 1*l*, 1*k*, and 1*j* or a surface portion of the connecting sheet 2*i* to define the outer surface of the block 10.

The pads 1*l*, 1*k*, and 1*j* each have opposite first and second major surfaces that are of the same rectangular shape and area, and have predetermined thicknesses between their major surfaces. The second major surface of the first pad 1*l* is attached (as by a suitable adhesive) to a first major surface of the connecting sheet 2*i*, the second surfaces of the second and third pads 1*k* and 1*j* are attached (as by a suitable adhesive) in directly opposed relationship respectively to the first surface and a second major surface of the connecting sheet with the hinge portion 3*i* of the connecting sheet 2*i* between the first pad 1*l* and the opposed second and third pads 1*k* and 1*j*. The length of the hinge portion 3*i* between the first pad 1*l* and the opposed second and third pads 1*k*, 1*i* is greater than the sum of the thicknesses of the first and second pads 1*l* and 1*k* and is also greater than the thickness of the third pad 1j so that the pads 1l, 1k, and 1j can alternately be positioned in a first configuration (FIG. 2) with the first surface of the third pad 1j against a portion of the second surface of the connecting sheet 2i opposite the first pad 1l and with the first surfaces of the first and second pads 1l and 1k of scouring material and abrasive material defining the opposite outer surfaces of the block 10; and in a second configuration (FIG. 3) with the first surfaces of the first and second pads 1l and 1k in contact and with the first surface of the third pad 1j of sponge material and the portion of the second surface of the connecting sheet 2i of wiping material opposite the first pad 1l defining the opposite outer surfaces of the block 10.

Preferably, as illustrated, the sum of the thicknesses of the first and second pads 1l and 1k is approximately equal to the thickness of the third pad 1j, and that sum is only slightly less than the length of the hinge portion 3i between the first pad 1l and the opposed second and third pads 1k and 1j so that the block will be a compact unit in either its first or second configuration, and so that the hinge portion 3i will conform closely along the side of the pads 1j or 1k and 1l to help hold the pads 1j, 1k, and 1l in either superimposed configuration.

Figure 4:
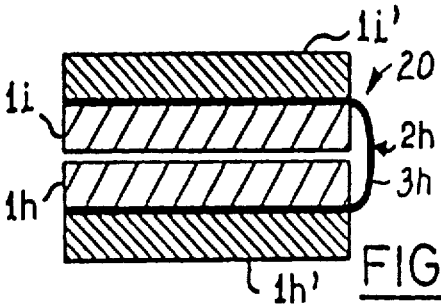
FIGS. 4 and 5 are end views of a second embodiment of a block according to the present invention in two different configurations.
Figure 8:
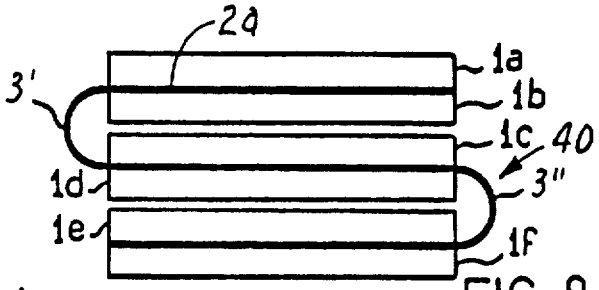
FIGS. 8, 9, 10 and 11 are end views of a fourth embodiment of a block according to the present invention in four different configurations.
Figure 5:
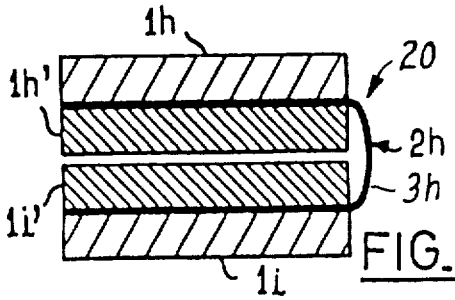
Figure 9:
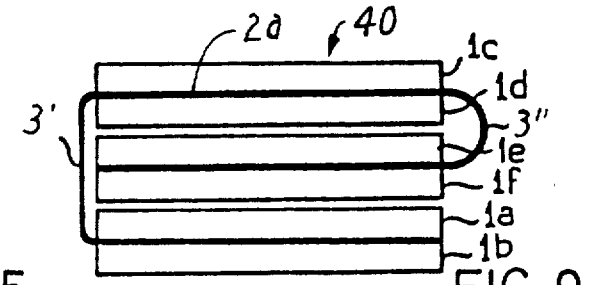

Referring now to the FIGS. 4 and 5 of the drawing, there is shown a second embodiment of a multifunctional composite block 20 according to the present invention for use in the manual treatment of surfaces.

Generally the block 20 comprises first, second, third and fourth rectangular pads 1i, 1i', 1h and 1h' which may be of the same or different materials (e.g., pads 1i and 1h being of hard abrasive material and pads 1i' and 1h' being of soft abrasive material) and a flexible connecting sheet 2h which has no function but to connect the pads 1i, 1i', 1h and 1h' and thus, for example, can be of a supple plastic material sheet such as vinyl or polyethylene chloride, or a textile strip. The pads 1i, 1i', 1h and 1h' are attached along the connecting sheet 2h in spaced relationship to define a hinge portion 3h of the connecting sheet 2h between adjacent portions of the pads 1i, 1i', 1h and 1h', which hinge portion 3h has a length permitting positioning the pads 1i, 1i', 1h and 1h' in two different superimposed configurations (FIGS. 4 and 5) to expose at will different surfaces of the pads 1i, 1i', 1h and 1h' to define the outer surface of the block 20.

The pads 1i, 1i', 1h and 1h' each have opposite first and second major surfaces that are of the same rectangular shape and area, and have predetermined thicknesses between their major surfaces. The second major surfaces of the first and third pads 1i and 1i' are adhered in directly opposed relationship to the first and second surfaces of the connecting sheet 2h, the second surfaces of the second and fourth pads 1h and 1h' are adhered in directly opposed relationship to the first and second surfaces of the connecting sheet 2h with the hinge portion 3h of the connecting sheet 2h being between the opposed first and third pads 1i and 1i' and the opposed second and fourth pads 1h and 1h'. The length of the hinge portion 3h between the opposed pairs of pads 1i, 1i' and 1h, 1h' is greater than the sum of the thicknesses of the pads 1i and 1h attached to the first surface of the connecting sheet and is also greater than the sum of the thicknesses of the pads 1i' and 1h' attached to the second side of the connecting sheet 2h so that the pads 1i, 1i', 1h, 1h' can alternately be positioned in a first configuration (FIG. 4) with the first surfaces of the pads 1i and 1h attached to the first surface of the connecting sheet 2h in contact and the first surfaces of the pads 1i' and 1h' of soft abrasive material attached to the second surface of the connecting sheet 2h defining the opposite outer surfaces of the block 20, and in a second configuration (FIG. 5) with the first surfaces of the pads 1h' and 1i' attached to the second surface of the connecting sheet 2h in contact and the first surfaces of the pads 1h and 1i of hard abrasive material attached on the first surface of the connecting sheet 2h defining the opposite outer surfaces of the block 20.

Preferably the sum of the thicknesses of the pads 1i and 1h attached to the first surface of the connecting sheet is approximately equal to the sum of the thickness of the pads 1i' and 1h' attached to the second side of the connecting sheet, and the sum is only slightly less than the length of the hinge portion between the opposed pairs of pads 1i, 1i' and 1h, 1h' so that the block 20 will be a compact unit in either its first or second configuration, and so that the hinge portion will conform closely along the side of the pads 1i and 1h or 1h' and 1i' to help hold the pads 1i, 1i', 1h and 1h' in a superimposed configuration.

Figure 6:
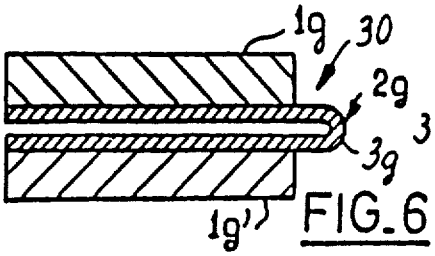
FIGS. 6 and 7 are end views of a third embodiment of a block according to the present invention in two different configurations.
Figure 10:
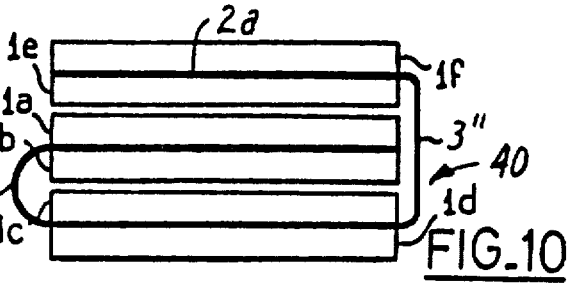
Figure 7:
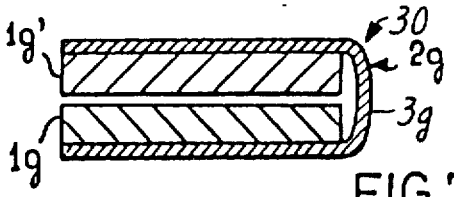
Figure 11:
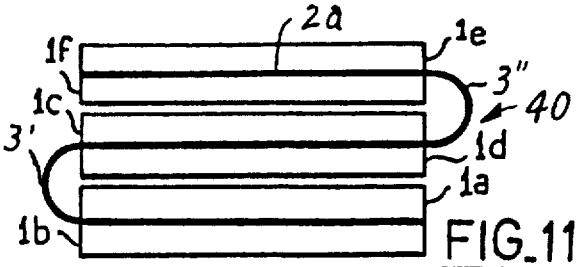

Referring now to the FIGS. 6 and 7 of the drawing, there is shown a third embodiment of a multifunctional composite block 30 according to the present invention for use in the manual treatment of surfaces.

Generally the block 30 comprises first and second rectangular pads 1g and 1g' which may be of the same or different abrasive materials, and a flexible connecting sheet 2g which may be of scouring material, such as the scouring material sold under the commercial designation "Scotchbrite" by Minnesota Mining and Manufacturing Company, St. Paul, Minn. The pads 1g and 1g' are attached along the same surface of the connecting sheet 2g in spaced relationship to define a hinge portion 3g of the connecting sheet 2g between adjacent portions of the pads 1g and 1g', which hinge portion has a length permitting positioning the pads 1g and 1g' in two different superimposed configurations to expose at will different surfaces of the pads 1g and 1g' (FIG. 6) or portions of the connecting sheet 2g opposite the pads 1g and 1g' to define the outer surface of the block 30.

Preferably the sum of the thicknesses of the pads 1g and 1g' is only slightly less than the length of the hinge portion 3g between the pads 1g and 1g' so that the block 30 will be a compact unit in its configuration with the pads 1g and 1g' in contact and so that the hinge portion 3g will conform closely along the side of the pads 1g and 1g' in that position to help hold the pads 1g and 1g' in that superimposed configuration.

Referring now to the FIGS. 8 through 11 of the drawing, there is shown a forth embodiment of a multifunctional composite block 40 according to the present invention for use in the manual treatment of surfaces.

Generally the block 40 comprises first, second, third, fourth, fifth and sixth rectangular pads 1a, 1d, 1b, 1c, 1e and 1f respectively which may be of the same or different materials and a flexible connecting sheet 2a which has no function but to connect the pads 1a, 1b, 1c, 1d, 1e and 1f and thus, for example, can be of a supple plastic material sheet such as vinyl or polyethylene chloride, or a textile strip. The pads 1a, 1b, 1c, 1d, 1e and 1f are attached (as by a suitable adhesive) along the connecting sheet 2a in spaced relationships to define two hinge portions 3' and 3'' of the connecting sheet 2a between adjacent portions of the pads 1a, 1d and 1e or 1b, 1c, and 1f, which hinge portions 3' and 3'' have lengths permitting positioning the pads 1a, 1b, 1c, 1d, 1e and 1f in four different superimposed configurations (FIGS. 8, 9, 10 and 11) to expose at will different surfaces of the pads 1a, 1b, 1c, 1d, 1e and 1f to define the outer surface of the block 40.

The pads 1a, 1b, 1c, 1d, 1e and 1f each have opposite first and second major surfaces that are of the same rectangular shape and area, and have predetermined thicknesses between their major surfaces. The second major surfaces of the first and third pads 1a and 1b are adhered in directly opposed relationship to the first and second surfaces of the connecting sheet, 2a the second surfaces of the second and fourth pads 1d and 1c are adhered in directly opposed relationship to the first and second surfaces of the connecting sheet 2a with the hinge portion 3' of the connecting sheet 2a being between the opposed first and third pads 1a and 1b and the opposed second and fourth pads 1d and 1c. The fifth and sixth pads 1e and 1f are attached in directly opposed relationship to the first and second surfaces of the connecting sheet 2a on the side of the second and fourth pads 1d and 1c opposite the first and third pads 1a and 1b with the fifth and sixth pads 1e and 1f being spaced from the second and fourth pads 1d and 1c to provide the second hinge portion 3" of the connecting sheet 2a between the opposed second and fourth pads 1d and 1c and the opposed fifth and sixth pads 1e and 1f. The hinge portions 2' and 2" are of sufficient length to afford alternately positioning the pads (1) in a first configuration (FIG. 8) with the first surfaces of the third and fourth pads 1b and 1c and of the second and fifth pads 1d and 1e in contact and with the first surfaces of the first and sixth pads 1a and 1f defining the opposite outer surfaces of the block 40; (2) in a second configuration (FIG. 9) with the first surfaces of the second and fifth pads 1d and 1e and of the sixth and first pads 1f and la in contact and with the first surfaces of the fourth and third pads 1c and 1b defining the opposite outer surfaces of the block 40; (3) in a third configuration (FIG. 10) with the first surfaces of the fifth and first pads 1e and 1a and of the third and fourth pads 1b and 1c in contact and with the first surfaces of the sixth and second pads 1f and 1d defining the opposite outer surfaces of the block 40; or (4) in a fourth configuration with the first surfaces of the sixth and fourth pads 1f and 1c and of the second and first pads 1d and 1a in contact and with the first surfaces of the fifth and third pads 1e and 1b defining the opposite outer surfaces of the block 40. The lengths of the hinge portions 3' and 3" are both greater than the sums of the thicknesses of the pads 1a, 1d, 1e and 1f and 1a, 1b, 1c, and 1e respectively to afford positioning the pads in the configurations shown in FIGS. 9 and 10.

The block according to the present invention has now been described with respect to four embodiments thereof. The materials of the pads and connecting sheets described in the those embodiments may be changed as may be appropriate to facilitate various uses for the blocks. For example, any of the blocks can be made using all abrasive or non-abrasive materials or combinations thereof. In blocks adapted for waxing and shining shoes, furniture and other articles, for example, the block may include one wiping pad of sponge material, one pad impregnated with wax, shoe polish, cream or a similar product, and one component for shining, such as a connecting sheet of natural or synthetic chamois leather, or of a woven or non woven textile material.

I claim:

1. A multifunctional composite block for manual treatment of surfaces, said block comprising first, second and third pads and including a flexible connecting sheet, said pads and said connecting sheet each have opposite first and second major surfaces and predetermined thicknesses between said surfaces, the second major surface of said first pad is attached to the first surface of said connecting sheet, the second surfaces of said second and third pads are attached respectively to said first and second surfaces of said connecting sheet in opposed relationship and in spaced relationship from said first pad to define a hinge portion of said connecting sheet between adjacent portions of said first pad and said opposed second and third pads, the length of said hinge portion between said first pad and said opposed second and third pads being greater than the sum of the thicknesses of said first and second pads and being greater than the thickness of the third pad so that said pads can alternately be positioned in a first configuration with the first surface of the third pad against a portion of the second surface of the connecting sheet opposite the first pad and with the surfaces of said first and second pads defining the opposite outer surfaces of said block, and in a second configuration with said first surfaces of said first and second pads in contact and with the first surface of said third pad and said portion of the second surface of said connecting sheet defining the opposite outer surfaces of said block.

2. A block according to claim 1 wherein the sum of the thicknesses of said first and second pads is approximately equal to the thickness of the third pad, and said sum is only slightly less than the length of said hinge portion between said first pad and said opposed second and third pads.

3. A block according to claim 1, wherein said different materials of said pads are selected from the group of materials consisting of abrasive material, sponge material, and scouring material without abrasive, and said flexible connecting sheet is formed of a material selected from the group of materials consisting of wiping material and scouring material.

4. A block according to claim 1, wherein one of said pads is of abrasive material, one of said pads is of scouring material without abrasive material, and one of said pads is of sponge material, and said flexible connecting sheet is of a soft absorbent wiping material.

5. A block according to claim 1 wherein said first and second pads are of abrasive material and scouring material without abrasive, said third pad is of sponge material, and said connecting sheet is of soft supple wiping material so that surfaces of the abrasive and scouring materials define opposite outer surfaces of said block in said first configuration, and surfaces of the sponge and wiping materials define opposite outer surfaces of said block in said second configuration.

6. A multifunctional composite block for manual treatment of surfaces, said block comprising first, second, third and fourth pads and including a flexible connecting sheet, said pads and said connecting sheet each have opposite first and second major surfaces and predetermined thicknesses between said surfaces, the second major surfaces of said first and third pads are adhered in opposed relationship to the first and second surfaces of said connecting sheet, the second surfaces of said second and fourth pads are adhered to said first and second surfaces of said connecting sheet in opposed relationship and in spaced relationship from said opposed first and third pads to define a hinge portion of said connecting sheet between adjacent portions of said opposed first and third pads and said opposed second and fourth pads, the length of said hinge portion between said opposed pairs of pads being greater than the sum of the thicknesses of said pads attached to the first surface of said connecting sheet and being greater than the sum of the thicknesses of the pads attached to the second side of the connecting sheet so that said pads can alternately be positioned in a first configuration with said first surfaces of said pads attached to the first surface of said connecting sheet in contact and the first surfaces of said blocks attached on the second surface of said connecting sheet defining the opposite outer surfaces of said block, and in a second configuration with the first surfaces of the pads attached to the second surface of the connecting sheet in contact and the first surfaces of said pads attached to the first surface of said connecting sheet defining the opposite outer surfaces of said block.

7. A block according to claim 6 wherein said different materials of said pads are selected from the group of materials consisting of abrasive material, sponge material, and scouring material without abrasive, and said flexible connecting sheet is formed of a material selected from the group of materials consisting of wiping material and scouring material.

8. A block according to claim 6 wherein the sum of the thicknesses of said pads attached to the first surface of said connecting sheet is approximately equal to the sum of the thickness of the pads attached to the second surface of the connecting sheet, and said sum is only slightly less than the length of said hinge portion between said opposed pairs of pads.

9. A multifunctional composite block for manual treatment of surfaces, said block comprising first, second, third and fourth fifth and sixth pads and including a flexible connecting sheet, said pads and said connecting sheet each have opposite first and second major surfaces and a predetermined thickness between said surfaces, the second major surfaces of said first and third pads are adhered in opposed relationship to the first and second surfaces of said connecting sheet, the second surfaces of said second and fourth pads are adhered to said first and second surfaces of said connecting sheet in opposed relationship and in spaced relationship from said opposed first and third pads to define a hinge portion of said connecting sheet between adjacent portions of said opposed first and third pads and said opposed second and fourth pads, the second major surfaces of said fifth and sixth pads are attached in opposed relationship to the surfaces of said connecting sheet on the side of said second and fourth pads opposite said first and third pads with said fifth and sixth pads being spaced from said second and fourth pads to provide a second hinge portion of said connecting sheet between adjacent portions of said opposed second and fourth pads and said opposed fifth and sixth pads, said hinge portions being of sufficient length to afford alternately positioning said pads in a first configuration with the first surfaces of said third and fourth pads and of said second and fifth pads in contact and with the first surfaces of the first and sixth pads defining the opposite outer surfaces of said bloc, in a second configuration with the first surfaces of said second and fifth pads and of said sixth and first pads in contact and with the first surfaces of the fourth and third pads defining the opposite outer surfaces of said block, in a third configuration with the first surfaces of said fifth and first pads and of said third and fourth pads in contact and with the first surfaces of the sixth and second pads defining the opposite outer surfaces of said block, or in a fourth configuration with the first surfaces of said sixth and fourth pads and of said second and first pads in contact and with the first surfaces of the fifth and third pads defining the opposite outer surfaces of said block.

10. A block according to claim 9, wherein said different materials of said pads are selected from the group of materials consisting of abrasive material, sponge material, and scouring material without abrasive, and said flexible connecting sheet is formed of a material selected from the group of materials consisting of wiping material and scouring material.

* * * * *

UNITED STATES PATENT AND TRADEMARK OFFICE

CERTIFICATE OF CORRECTION

PATENT NO. : 5,140,785

DATED : August 25, 1992

INVENTOR(S) : Bernard Eleouet

It is certified that error appears in the above-indentified patent and that said Letters Patent is hereby corrected as shown below:

Col. 5, line 26, replace "2′ and 2"" with --3′ and 3"--;

Col. 5, line 34, replace "la" with --1a--.

Signed and Sealed this

Twentieth Day of September, 1994

*Attest:*

*Attesting Officer*

BRUCE LEHMAN

*Commissioner of Patents and Trademarks*